US009173481B2

(12) United States Patent
Haansbæk et al.

(10) Patent No.: US 9,173,481 B2
(45) Date of Patent: Nov. 3, 2015

(54) EXTENSION TABLE WITH MULTIPLE LEGS

(71) Applicant: SKOVBY MØBELFABRIK A/S, Galten (DK)

(72) Inventors: Per Haansbæk, Højbjerg (DK); Preben Rasmussen, Galten (DK)

(73) Assignee: SKOVBY MØBELFABRIK A/S, Galten (DK)

( * ) Notice: Subject to any disclaimer, the term of this patent is extended or adjusted under 35 U.S.C. 154(b) by 0 days.

(21) Appl. No.: 14/371,348

(22) PCT Filed: Jan. 9, 2013

(86) PCT No.: PCT/EP2013/050249

§ 371 (c)(1),
(2) Date: Jul. 9, 2014

(87) PCT Pub. No.: WO2013/104639

PCT Pub. Date: Jul. 18, 2013

(65) Prior Publication Data

US 2014/0352579 A1 Dec. 4, 2014

(30) Foreign Application Priority Data

Jan. 10, 2012 (DK) ..... BA 2012 00005

(51) Int. Cl.
*A47B 1/08* (2006.01)
*A47B 1/02* (2006.01)
(Continued)

(52) U.S. Cl.
CPC ... *A47B 1/02* (2013.01); *A47B 1/05* (2013.01); *A47B 13/021* (2013.01); *A47B 2200/005* (2013.01)

(58) Field of Classification Search
CPC ..... A47B 13/021; A47B 1/08; A47B 1/03; A47B 2001/085
USPC ..... 108/64, 83–86, 88, 174, 169; 248/188, 248/188.1
See application file for complete search history.

(56) References Cited

U.S. PATENT DOCUMENTS 642,962 A * 2/1900 Danner ..... 108/155
769,699 A 9/1904 Klein
1,086,941 A 2/1914 Sarkoze
(Continued)

FOREIGN PATENT DOCUMENTS

GB 01204 A 0/1911

OTHER PUBLICATIONS

EPO (ISA/EP) International Search Report for International Application No. PCT/EP2013/050249 International Filing Date Jan. 9, 2013, as completed May 15, 2013 (4 pages).
(Continued)

*Primary Examiner* — Hanh V Tran
(74) *Attorney, Agent, or Firm* — Barclay Damon LLP

(57) ABSTRACT

An extension table with multiple legs with two table tops sliding back and forth in relation to each other and at least one leaf and at least four supporting members each comprising at least two table legs, including a first table leg and a second table leg. The supporting members support the extension table when the sliding table tops are joined in a first position, and they support the extension table when the sliding table tops are pulled apart in a second position. The first table legs in each supporting member are directly or indirectly connected to the sliding table tops through fasteners which, in one embodiment, comprise sliding means.

20 Claims, 6 Drawing Sheets

(51) Int. Cl.
*A47B 1/05* (2006.01)
*A47B 13/02* (2006.01)

(56) References Cited

U.S. PATENT DOCUMENTS

| | | | | | |
|---|---|---|---|---|---|
| 1,197,172 | A | * | 9/1916 | Baldi | 108/63 |
| 2,162,032 | A | * | 6/1939 | Rudman et al. | 108/79 |
| 2,666,680 | A | * | 1/1954 | Alperstein | 108/70 |
| 3,136,517 | A | | 6/1964 | Gariepy | |
| 5,711,229 | A | * | 1/1998 | Piretti | 108/67 |
| 5,988,077 | A | * | 11/1999 | Balderi | 108/64 |
| 6,220,187 | B1 | | 4/2001 | Grosser | |
| 2006/0032415 | A1 | * | 2/2006 | Wang | 108/83 |

OTHER PUBLICATIONS

EPO (ISA/EP) Written Opinion of the International Preliminary Authority (PCT Rule 66) form PCT/IPEA/408, dated Jan. 9, 2014 (5 pages).

Written Opinion of the International Searching Authority (PCT Rule 43 bis.1) form PCT/ISA/237 and Response to Written Opinion with Amended Claims and letter from EPO accompanying subsequently filed items dated Mar. 4, 2014 (13 pages).

International Preliminary Report on Patentability form PCT/IPEA/409, dated Jun. 6, 2014 (5 pages).

* cited by examiner

EXTENSION TABLE WITH MULTIPLE LEGS

CROSS REFERENCE TO RELATED APPLICATION

This application is a national stage application pursuant to 35 U.S.C. §371 of International Application No. PCT/EP2013/050249, filed Jan. 9, 2013, which claims priority to, and the benefit of, Danish Patent Application No. BA 2012 00005, filed on Jan. 10, 2012, now Danish Patent No. BR 2012 00005, issued on Apr. 29, 2013, the entire contents of which are hereby incorporated herein by reference.

TECHNICAL FIELD

The invention relates to an extension table with multiple legs with two sliding table tops sliding back and forth in relation to each other and a number of leaves and at least four supporting members each comprising at least two table legs—a first table leg and a second table leg—said supporting members supporting the extension table with multiple legs when the sliding table tops are joined in a first position and supporting the extension table when the sliding table tops are pulled apart in a second position

BACKGROUND

U.S. Pat. No. 1,086,941 discloses an extension table with multiple legs having four corners each comprising supporting members, said supporting members comprising four legs that are separated when the table is extended so that two of the legs stay in place while the two remaining legs follow the leaf, thereby supporting the extended leaf. However, when the table is made of a living material like wood, the system is problematic. Since wood extends and contracts due to inter alia humidity and temperature as well as the characteristics of the chosen material, it is ascertained that for every two meters of a table, the table may extend and/or contract by two centimeters as a consequence of the outer conditions. Naturally, this creates tension in the table and may result in the collapse or cracking of the table or parts of the table.

Additionally, there is a risk of the table not being stable when assembled when a supporting leg leans compared to the leg with which it belongs. Consequently, the two concurrent legs may not be as supporting and stabilising as they would otherwise be when assembled. Furthermore, there is a risk of the table being unstable when the legs are separated, whereby the legs wobble, especially when the ground is uneven.

DISCLOSURE OF THE INVENTION

The aspect of the invention is to provide an extension table with multiple legs without the above-mentioned disadvantages or at least to provide a useful alternative.

The aspect is achieved by an extension table with multiple legs according to the introduction and where the first table legs in each supporting member are directly or indirectly connected to the sliding table tops by means of fasteners comprising sliding means, and by said fastener, the first table leg and the corresponding sliding table top are arranged to slide relative to each other from a position A to a second position B differing from position A and at least in the extension direction of the table and with fastening means co-operating with the sliding means of the fastener in order to secure the first table leg in the chosen position.

The table, which may be completely or partially made of a wooden material, has at least four supporting members placed in each corner so that each leaf of the extension table with multiple legs has at least two supporting members. Thereby, each supporting member comprises two legs that are close to each other in a first position, whereby, in principle, the legs stabilise each other. When the table is extended, the legs in each supporting member comprise a first leg and a second leg. The second leg is mounted to the stationary rail, while the first legs being directly or indirectly connected to the extension table are removed from the stationary second leg, thereby supporting the extended table top.

Typically, the leaves will be placed in box-shaped cavities under the table tops when said table tops are pulled apart. Said cavities are provided by longitudinal stationary rails and transverse rails forming a fixed box to which the second table legs are mounted. The first table legs may be directly or indirectly connected to the sliding table tops as the first table legs may be connected to a transverse rail. Thereby said transverse rail is mounted on the sliding table top by means of a fastener. Alternatively, the first table legs may be mounted by a fastener directly to the underside of the sliding table top, or the rail to which the legs are fastened may be adjusted.

At the moment the table changes its dimensions due to for example a change in temperature creating tensions, it is possible to release these tensions by means of the fastener placed under the table top. The fastener comprises sliding means cooperating with the fastening means, said fastening means is released. The fastener, which may be angle brackets with oval bores, ensures that the table top can slide a given distance in relation to the first table leg from a position A to a position B as the position of the bracket is adjusted to the longitudinal direction of the extension table with multiple legs, so that tension is released. Subsequently, by means of the fastening means, the sliding top will be fixedly mounted to the first table leg, thereby stabilising the table leg without tension. Preferably, the fastening means is a separate means such as a screw.

According to an alternative embodiment of the invention, the extension table with multiple legs comprises a rail being transverse in relation to the direction of extension, said rail being connected to the two first table legs both supporting the same slidable table top.

By this construction, in which a transverse rail is used, it is ensured that the first two table legs may be synchronically slid, each keeping their mutual position. This is also a simple way of sliding the table legs.

According to another embodiment of the invention, the fastener comprises a mounting or a transverse rail and the sliding means of the fastener comprise at least two oval bores in each mounting or rail, said longitudinal axis of the oval bores being axis-parallel with the direction of extension of the extension table with multiple legs, and in said bores, fastening means such as screws, bolts, pins, threaded rods and nuts cooperate with the bores for fastening of the fastener in a certain position.

Thereby, the sliding of table legs takes place by the brackets being adjustable, said brackets being fastened to each table leg or to the rail, where the table legs are mounted. Alternatively, the oval bores are provided directly in the rail, thereby being able to adjust its position.

According to another embodiment of the invention, the rail is fastened to the sliding table top by means of a separate fastener and the sliding means of the fastener comprise at least two oval bores in each mounting, said longitudinal axis of the oval bores being axis-parallel with the direction of extension of the extension table with multiple legs, and in said bores, mounting means such as screws, bolts, pins, threaded rods and nuts co-operate with the bores for fastening of the fastener in a certain position.

In this case, the rail is fastened to a fastener, said fastener being a bracket. The position of the bracket, and thereby the rail and the table legs, may be adjusted.

According to another embodiment of the invention, the fastener comprises at least one mounting comprising a first sheet part and a second sheet part protruding essentially perpendicularly from said first sheet part, said first sheet part being arranged to be directly or indirectly connected to the first table leg, and said second sheet part comprising sliding means and being arranged to be connected with the sliding table top by means of the fastening means.

This is a preferred embodiment of the fastener. Said fastener having the shape of an angle bracket, where the first top part is fastened to either a rail or directly to the first table leg, is immovable in relation to this top, while the second top part comprises sliding means cooperating with the fastening means. Thereby, the sliding means ensure a connection without tension.

According to another embodiment of the invention, the fastener comprises at least one mounting comprising a first sheet part, a second sheet part protruding essentially perpendicularly from said first sheet part, said first sheet part being arranged to be connected with the transverse rail, and said second sheet part comprising sliding means and being arranged to be connected with the sliding table top by means of the fastening means.

By this embodiment, the second top part is connected to the underside of the sliding table top, while the first top part is connected to the transverse rail being immovable in relation to this. Typically, the first top part is fastened to the rail by means of screws or bolts fitting into the pre-cut threaded hole. Thereby, the second top part can slide in relation to the table top.

According to another embodiment of the invention, the fastener comprises at least one mounting comprising a first sheet part and a second sheet part protruding essentially perpendicularly from said first sheet part, said first sheet part being arranged to be connected with the first table legs and said second sheet part comprising sliding means and being arranged to be connected with the sliding table top by means of the fastening means.

By this embodiment, the second top part is connected to the underside of the sliding table top, while the first top part is connected to the first table leg being immovable in relation to this. Typically, the first top part is fastened to the rail by means of screws or bolts fitting into the pre-cut threaded hole.

According to another embodiment of the invention, the fastener comprises at least two mountings connected to the transverse rail or each mounted to separate first table legs.

By using two mountings, a stable construction is achieved.

According to another embodiment of the invention, the sliding means comprise at least two, preferably four, oval bores, said longitudinal axis of the bores being parallel with the direction of extension of the extension table with multiple legs, and in said bores, the mounting means consisting of screws, bolts, pins, threaded rods and nuts cooperate with the bores for fastening of the fastener in a certain position.

This is a preferred embodiment of the sliding means, as the oval shape ensures that the sliding of the mounting is precise and in the direction of the extension. However, depending on the lateral shape of the oval bore, it may also be possible to slide the mounting sideways. In the longitudinal direction, there are good possibilities for sliding and depending on the length of the bores, the position of the first legs may be adjusted in order to release the tension.

According to another embodiment of the invention, the bores in the longitudinal direction are at least twice the diameter of the fastening means, preferably two to six times the diameter, said fastening means having essentially circular cross sections.

This is a preferred dimension of the bores allowing sufficient adjustment of the table legs.

According to another embodiment of the invention, the sliding table tops each being supported by at least two supporting members when the extension table with multiple legs is in its first position.

Preferably, said supporting members are placed opposite each other.

According to another embodiment of the invention, the sliding table tops each being supported by at least two first legs when the extension table with multiple legs is in its second position.

Preferably, the first table legs are placed opposite each other.

According to another embodiment of the invention, the extension table with multiple legs is completely or partially made of wood or a wood-containing material.

The material may be chipboard, wooden laminate etc.

According to another embodiment of the invention, the contact face of the first table leg, which contact face abuts a surface of the second table leg in the first position of the sliding table tops, and said surface of the second table leg are congruent.

Thereby, a good stability of the supporting legs is achieved when the sliding table tops are in a first position as the tops support each other.

According to another embodiment of the invention, the contact face of the first table leg, which contact face abuts the surface of the second table leg in the first position, and said surface of the second table leg are plane.

Thereby, a good stability of the supporting legs is achieved in a simple manner when the sliding table tops are in a first position.

BRIEF DESCRIPTION OF THE DRAWING(S)

The invention is explained in detail below with reference to the drawing(s), in which FIG. 1 shows an extension table with multiple legs according to the invention in its first position, e.g. the sliding table tops are joined.

DETAILED DESCRIPTION OF THE INVENTION

Figure 1:
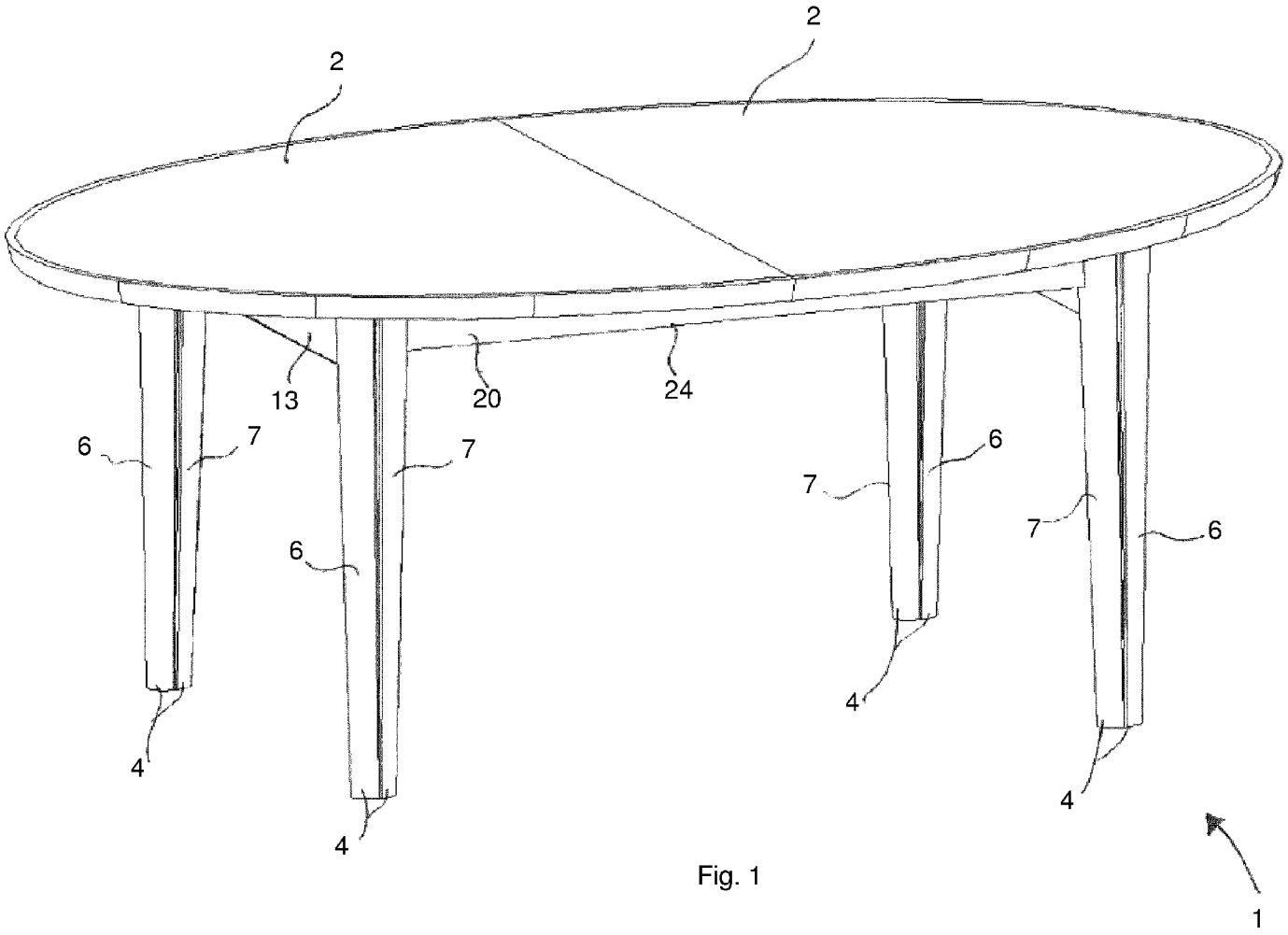

FIG. 1 shows an extension table with multiple legs 1 according to the invention comprising two sliding table tops 2 being supported by four supporting members 4. A supporting member 4 comprises a first table leg 6 and a second table leg 7. Said two table legs are placed as close to each other as possible when the table 1 is not extended, i.e. in its first position. Typically, the supporting members 4 are oval when seen in cross-sectional view, the longitudinal axis being parallel with the direction of extension of the extension table with multiple legs. The first table leg 6 and the second table leg 7 are half of an oval when seen in a cross-sectional view, and the flat sides of the legs abut each other in the first position. Essentially, the two surfaces abutting each other completely or partially are congruent and thereby, the two surfaces cover each other. In the shown embodiment, the two surfaces are plane. However, the surfaces may bend so that one surface is convex and the other surface is concave, said surfaces still being congruent.

The second table leg 7 is mounted to a box-shaped frame 24 comprising longitudinal stationary rails 20. The first table leg 6 is mounted to the underside of the sliding table tops 2 so that when said table tops are being slid, the first table leg 6 also slides. The position of the table leg 6 being separated as much as possible from the second table leg 7 is called the second position. The first table leg 6 may be directly connected to the sliding table tops 2 by a fastener, or it may be indirectly connected by being mounted to a transverse rail 13, said transverse rail 13 being mounted to the underside of the sliding table tops 2 by means of the fastener 8. The transverse rail 13 may be slid as explained below.

Figure 2:
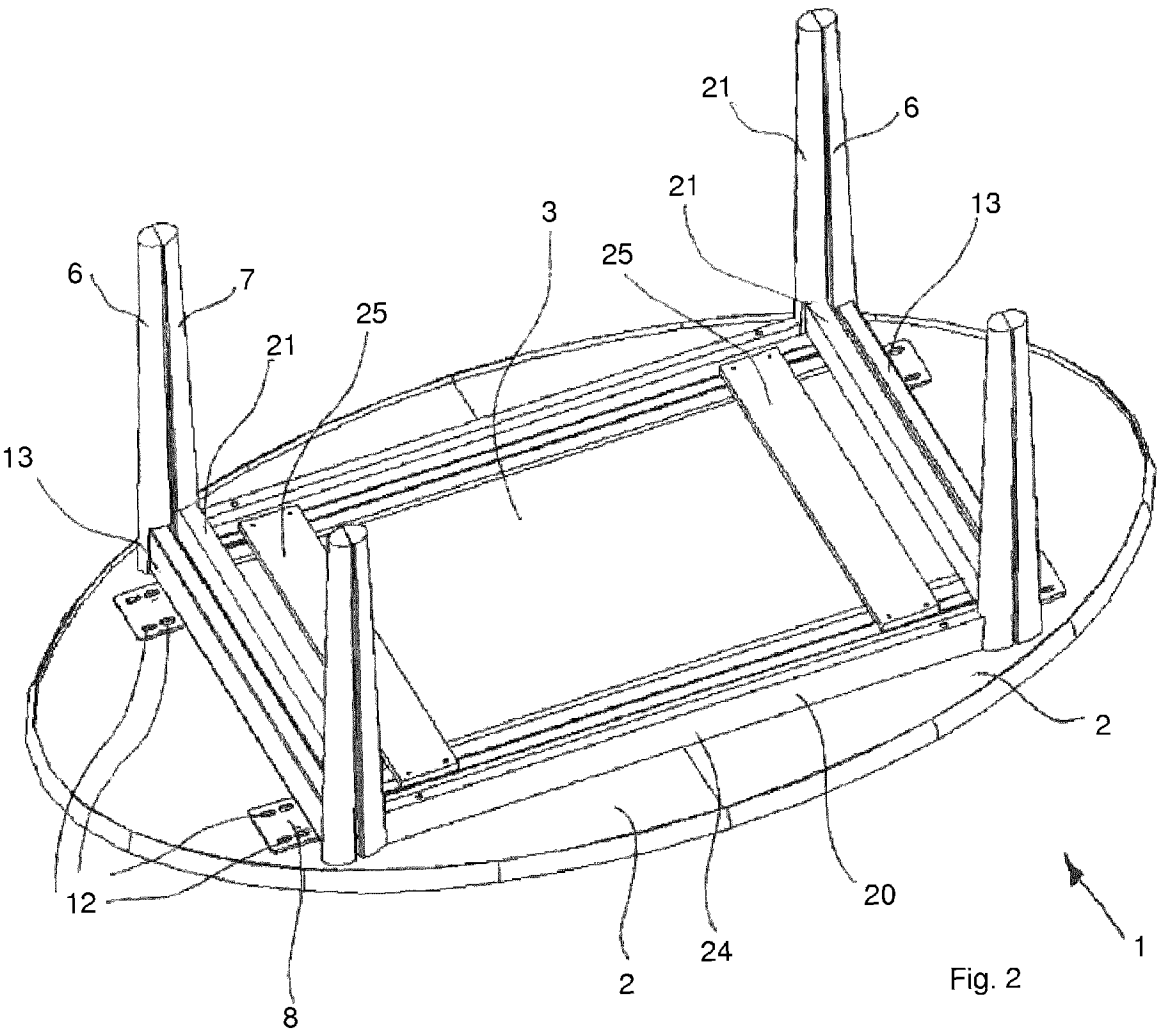
FIG. 2 shows the extension table with multiple legs shown in FIG. 1 from the underside.

FIG. 2 shows the extension table with multiple legs 1 shown in FIG. 1 from the underside and shows the stationary frame 24 provided by the two longitudinal stationary rails 20 being connected to each other by means of two transverse fixed rails 21. The longitudinal sliding rails 22 are placed along the longitudinal stationary rails 20. The sliding table top 2 is connected to the sliding rails 22 so that the right sliding table top is mounted to a set of sliding rails, and the left sliding table top is mounted to another set of sliding rails. The sliding rails are controlled by a groove/recess arrangement or by being placed between a set of stationary rails. The stationary frame 24 may be strengthened by a set of transverse boards 25 forming the bottom of the stationary frame 24 so that the leaves 3 may be placed therein. The first table legs 6 are each mounted to a transverse rail 13 in pairs, said transverse rails being mounted to the underside of the sliding table tops 2 by means of a fastener 8, preferably an angle bracket. The angle bracket 8 is fastened to the transverse rail 13 and the underside of the table top 2. The fastener 8 comprises sliding means 12 being longitudinal and through-going bores, whose longitudinal axis is axis-parallel with the direction of extension of the extension table. The bores are oval. Fastening means 11—not shown on the figure—such as screws, nuts and bolts, which are fitted in the pre-carved thread, attach the mounting to the underside of the table. By means of the longitudinal, oval bores 12, the transverse rail 13 and thereby the table legs 6 may change their position from a position A to a position B differing from position A. The position may be changed by adjusting the position of the fastener 8, which is done by loosening the screws inside the longitudinal bores and then slide the rail 13 in the direction of extension of the extension table and possibly perpendicularly, as the rail is now loosened in relation to the table top. Thereby, the table legs 6 are slided to an appropriate position. Subsequently, the fastener 8 is tightened by means of the fastening means 11.

Figure 3:
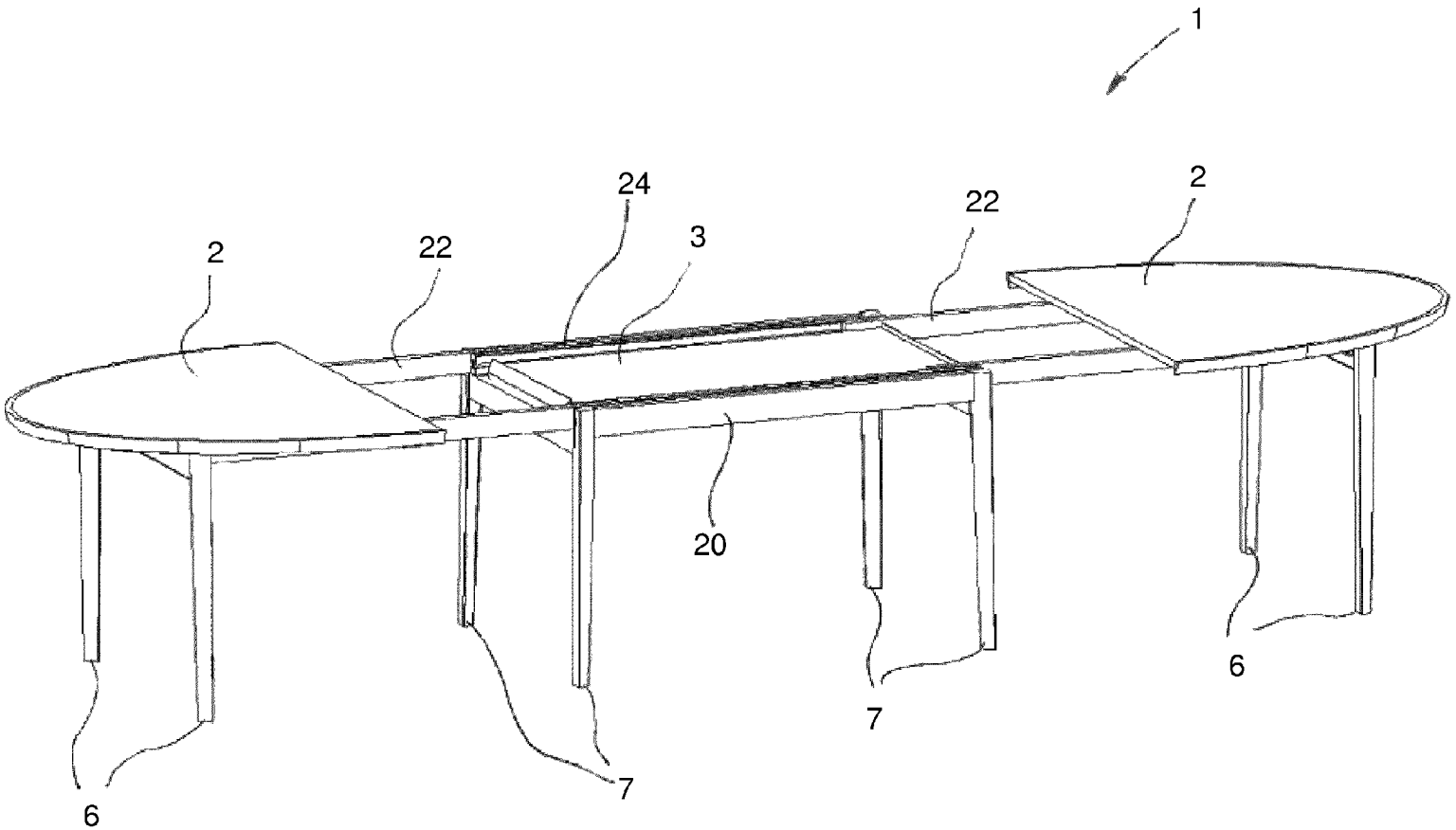
FIG. 3 shows the extension table with multiple legs shown in FIG. 1, where the sliding tops are pulled apart.

FIG. 3 shows the extension table with multiple legs shown in FIG. 1 being extended, i.e. the second position. The stationary frame 24 comprises the leaves 3 and the longitudinal sliding rails 22 are separated as much as possible. In the shown embodiment, the length of the table is changed from 2 meters in a joined position, as shown in FIG. 1, to 8 meters as shown in the present figure. By this extension, the support members 4, i.e. the first table leg 6 and the second table 7 leg, separated as much as possible.

Figure 4:
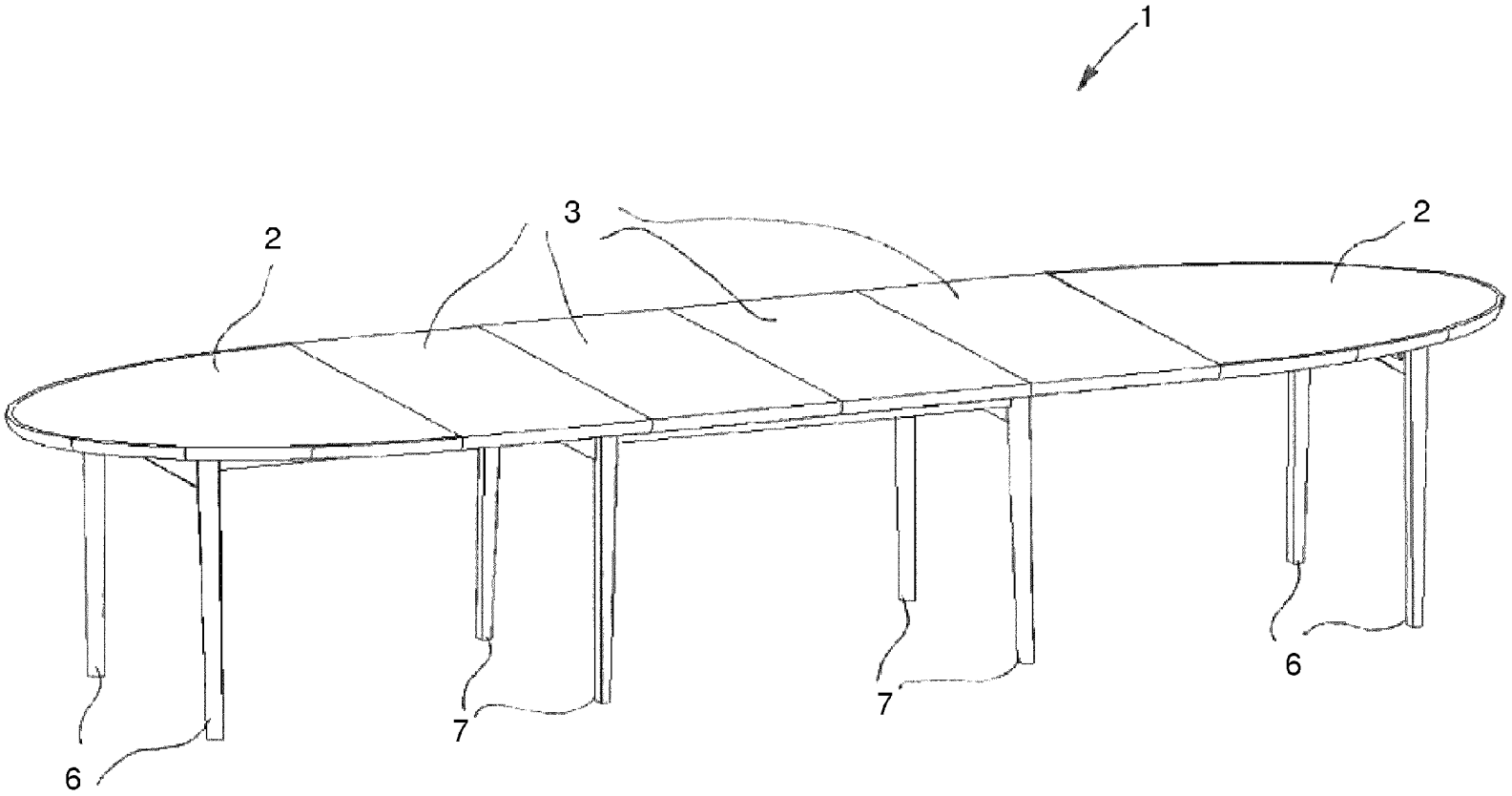
FIG. 4 shows the extension table shown in FIG. 3, where the leaf is placed between the sliding tops.
Figure 5:
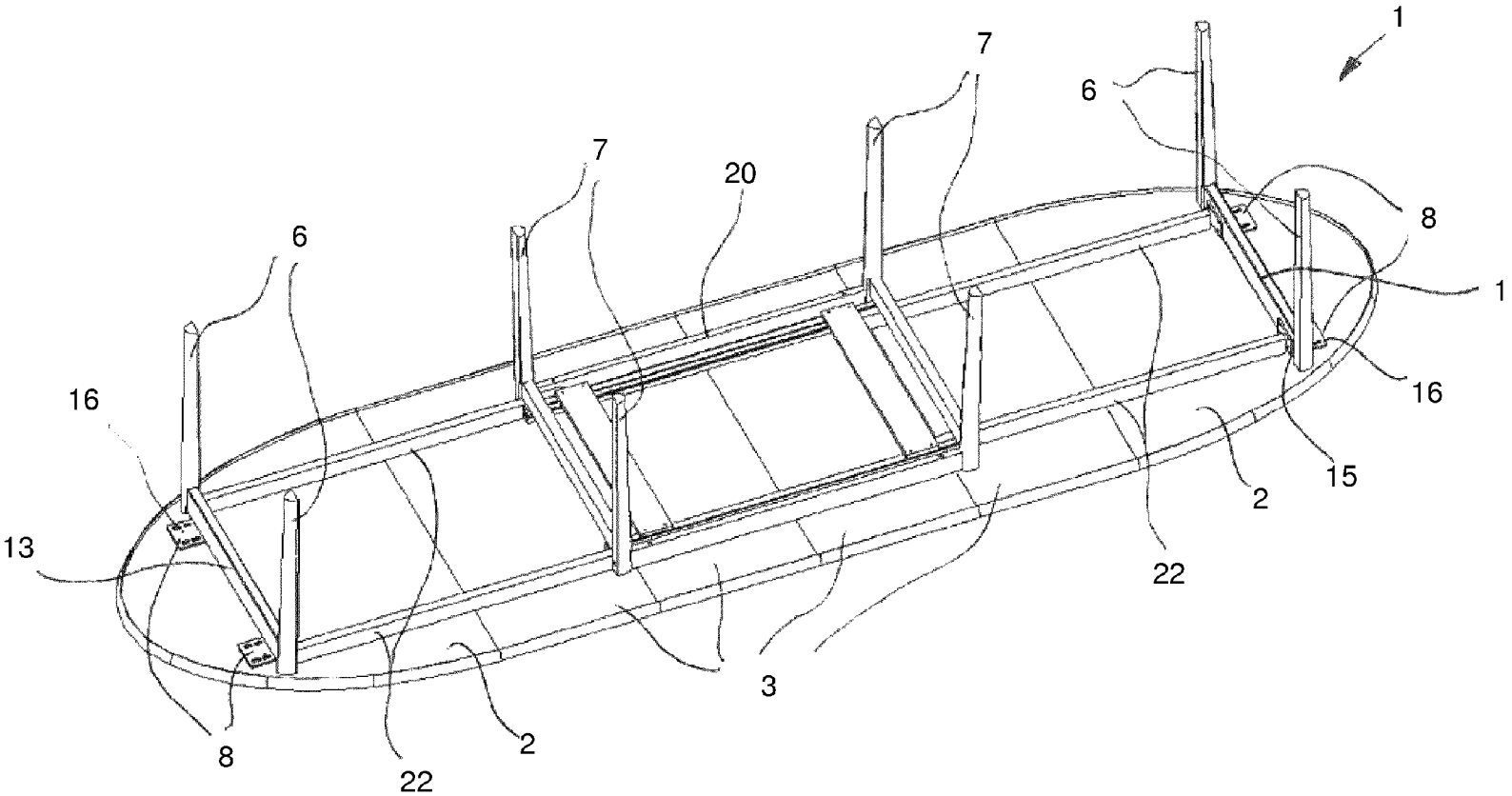
FIG. 5 shows the extension table shown in FIG. 4 from the underside.
Figure 6:
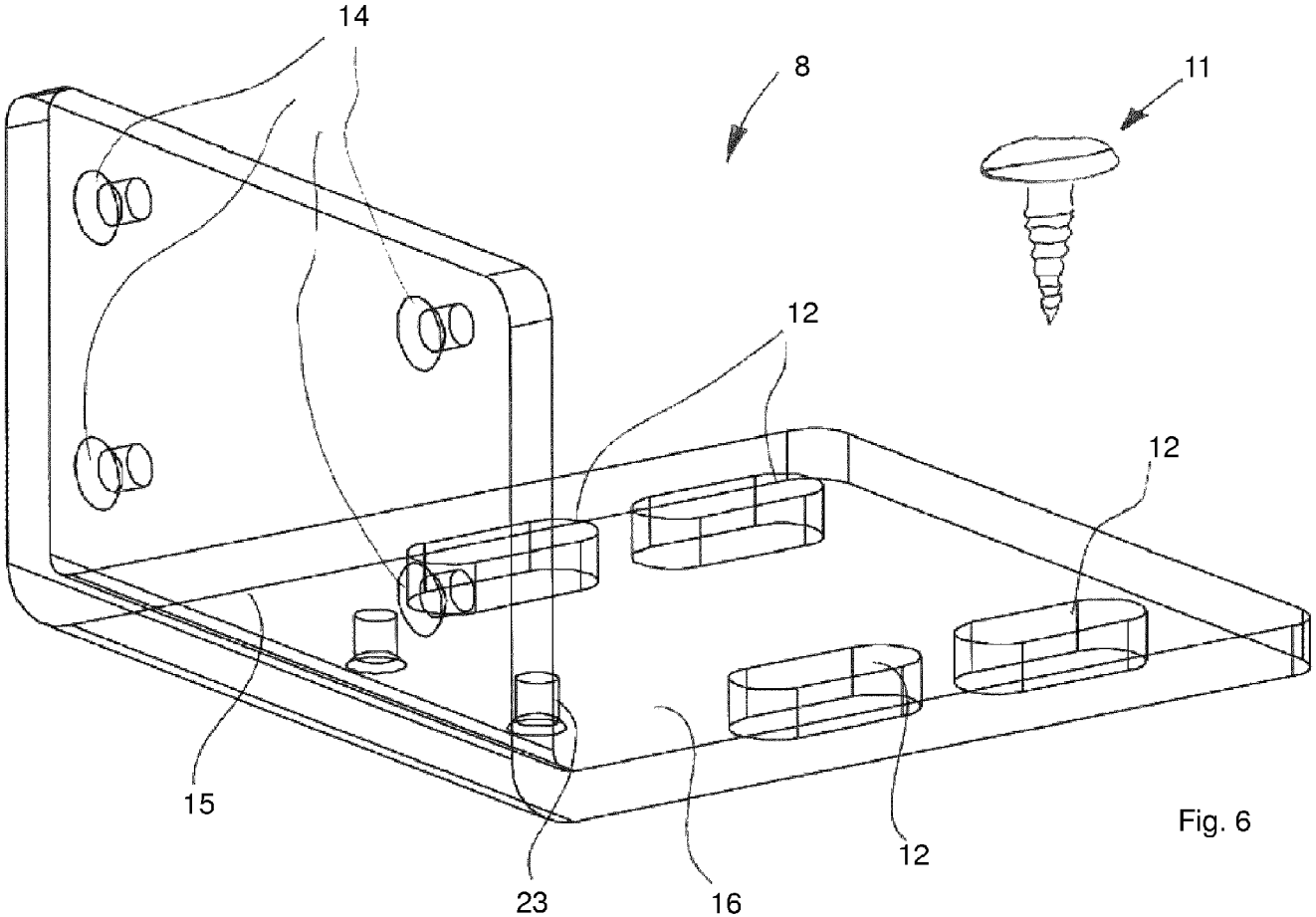
FIG. 6 shows a fastener and associated fastening means.

FIG. 4 shows the extension table with multiple legs 1 shown in FIG. 3, where the leaves 3 are removed from the cavity in the stationary frame 24 and placed on the longitudinal rails, both the stationary rails 20 and the sliding rails 22. FIG. 5 shows the same table/embodiment seen from underneath. With reference to FIG. 6, the fastener 8 comprises a first top part 15 and an essentially perpendicular protruding second top part 16. The first top part 15 is stationary mounted to the transverse rail 13, while the other top part 16 comprises sliding means 12 such as the previously mentioned oval bores, in which a fastening means 11, in this case a screw, fits. The sliding table top 2 and the first table legs 6 are fastened to each other to a position A by means of screws. If the position and thereby the relation between the first table leg 6 and the table top is changed from a position B differing from position A, the screws are loosened so that the sliding means 12 of the fastener 8 ensure that the mounting is slided back and forth. Essentially, the sliding back and forth is axis-parallel with the direction of extension of the extension table by means of the cooperation between the screw 11 and the oval bore 12. Said oval bore functions as a slide, although a slip occurs creating the risk of a small lateral staggering. Thereby, the first table legs 6 have the intended position in relation to the table top 2 and the second table leg 7. Thus, the legs can be adjusted to avoid tension in the construction.

Typically, the fastener is fastened to the transverse rail 13 by means of circular holes 14 arranged in the first top part 15, in which an appropriate screw fits. Fastener 8 may be fastened directly to each of the first table legs 6 instead of being fastened to the transverse rail 13. Thereby, the first table legs 6 may be adjusted independently of one another. This may be interesting, for example when the table is in a first position, i.e. joined, and the table legs are adjusted from a position A to the second position B and B'. In the chosen embodiment, an angle bracket with oval bores is shown.

Other types of fasteners with integrated sliding means may be used. For instance, oval bores in the actual rail 13 may be provided, whereby the rail and the first table legs fastened to the rail may be slid. In that case, the oval bores in the rail are provided with the longitudinal axis of the oval being axis parallel with the direction of extension of the extension table. The bores extend through the entire thickness of the rail measured perpendicularly on the underside of the table. In this example, the fastening takes place with a threaded rod going through the oval bore in the rail, said rod being fastened to the underside of the table top, where the fastening means are made up of wing nuts fastening and loosening the rail into the wanted positions.

Preferably, the table according to the invention is made of wood, completely or partially, or of a wood-like material such as chip board, laminate etc.

REFERENCE NUMERALS

1 Extension table with multiple legs
2 Sliding table tops
3 Leaf
4 Supporting members
6 First table leg
7 Second table leg
8 Fastener
11 Fastening means
12 Sliding means
13 Transverse rail
14 Hole in first top sheet part
15 First sheet part
16 Second sheet part protruding perpendicularly
20 Longitudinal stationary rail
21 Second transverse rail
22 Longitudinal sliding rail
23 Additionally circular bores

24 Stationary frame
25 Boards

The invention claimed is:

1. An extension table with multiple legs, the extension table comprising:

at least two slidable table tops configured to slide back and forth in relation to each other; and a plurality of leaves; and at least four supporting members, each comprising a plurality of table legs, including a first table leg and a second table leg, said supporting members supporting the slidable table tops when the slidable table tops are pushed together in a first stationary position and supporting the slidable table tops when the sliding table tops are fully pulled apart in a second stationary position, wherein the first table legs in each one of the supporting members is directly or indirectly connected to one of the slidable table tops by a fastener, the fastener comprising a fastener portion configured to slidably cooperate with a coupler, and when the slidable table tops are in the second stationary position, each one of the first table legs being slidably adjustable relative to the connected corresponding slidable table top from a position A to a second position B differing from position A and at least in an extension direction of the extension table and with the couplers co-operating with the fastener portions of the fasteners in order to secure each one of the first table legs in chosen positions, the adjustment of the first table legs being operable to relieve tension in the slidable table tops.

2. The extension table of claim 1, wherein the extension table comprises a rail being transverse in relation to the extension direction, said rail being connected to two adjacent table legs both supporting the same slidable table top.

3. The extension table of claim 1, wherein the fastener comprises a mounting and the fastener portion of the fastener comprises at least two oval bores in each mounting, the oval bores extending relative to a longitudinal axis, said longitudinal axis of the oval bores being axis-parallel with the extension direction of the extension table, and in said bores, the couplers co-operate with the bores for fastening of the fastener in a certain position, the couplers being selected from the group consisting of screws, bolts, pins, threaded rods and nuts.

4. The extension table of claim 2, wherein the rail is fastened to the sliding table top through a separate fastener and the fastener portion of the fastener comprises at least two oval bores in each mounting extending relative to a longitudinal axis, said longitudinal axis of the oval bores being axis-parallel with the extension direction of the extension table, and in said bores, the couplers co-operate with the bores for fastening of the fastener in a certain position, the couplers being selected from the group consisting of screws, bolts, pins, threaded rods and nuts.

5. The extension table of claim 1, wherein the fastener comprises at least one mounting comprising a first sheet part and a second sheet part protruding essentially perpendicularly from said first sheet part, said first sheet part being arranged to be directly or indirectly connected to one of the first table legs and said second sheet part comprising one of the fastener portions and being arranged to be connected with the slidable table top through one of the couplers.

6. The extension table of claim 2, wherein the fastener comprises at least one mounting comprising a first sheet part, a second sheet part protruding essentially perpendicularly from said first sheet part, said first sheet part being arranged to be connected with the rail, and said second sheet part comprising one of the fastener portions and being arranged to be connected with the slidable table top through one of the couplers.

7. The extension table of claim 1, wherein the fastener comprises at least one mounting comprising a first sheet part and a second sheet part protruding essentially perpendicularly from said first sheet part, said first sheet part being arranged to be connected with the first table legs and said second sheet part comprising one of the fastener portions and being arranged to be connected with the slidable table top through one of the couplers.

8. The extension table of claim 2, wherein the fastener comprises at least two mountings connected to one of the rail or at least one of the first table legs.

9. The extension table of claim 1, wherein each one of the fastener portions comprises a sliding means, the sliding means comprising at least two oval bores extending relative to a longitudinal axis, said longitudinal axis of the bores being parallel with the extension direction of the extension table, and in said bores, the couplers being selected from the group consisting of screws, bolts, pins, threaded rods and nuts which co-operate with the bores for fastening of the fasteners in desired positions.

10. The extension table of claim 9, wherein the bores extend in a longitudinal direction, the bores being at least twice in diameter of one of the couplers, said coupler having essentially a circular cross section.

11. The extension table of claim 1, wherein the slidable table tops are each supported by at least two of the supporting members when the extension table is in the first stationary position, wherein each one of the supporting members comprises one of the first legs.

12. The extension table of claim 1, which comprises a plurality of outer leg structures, each one of the outer leg structures comprising: (a) a set of the first legs; and (b) a rail that connects the first legs together, wherein, when the extension table is in the second stationary position: (i) the outer leg structures are configured to be moved relative to each other due to adjustment of the fasteners; and (ii) each one of the outer leg structures is configured to be moved relative to one of the slidable table tops due to adjustment of the fasteners.

13. The extension table of claim 1, wherein the extension table is completely or partially made of a material selected from the group consisting of wood or a wood-containing material.

14. The extension table of claim 1, wherein each one of the first table legs comprises a contact face, the contact face configured to abuts a surface of one of the second table legs in the first stationary position of the slidable table tops, wherein the contact face and said surface of the second table leg are congruent.

15. The extension table of claim 14, wherein both the contact face of the first table leg, which contact face abuts the surface of the second table leg in the first position, and said surface of the second table leg extend in a plane.

16. An extension table comprising:

a plurality of table tops configured to slide back and forth relative to each other;

at least one leaf configured to be positioned between the table tops;

a plurality of leg sets, each one of the leg sets comprising a plurality of legs, the leg sets configured to:

(a) support the table tops when the table tops are pushed together in a first position of the extension table; and (b) support the table tops when the table tops are fully pulled apart in a second position of the extension table;

a first fastener comprising a first table engagement part, the first table engagement part defining a first range of table coupling positions, the first fastener configured to couple a first one of the leg sets to a first one of the table tops, wherein, when the extension table is in the second position, the table coupling positions of the first range are adjustable to enable movement between the first leg set and the first table top so as to reduce a force acting between the first table top and the at least one leaf; and a second fastener comprising a second table engagement part, the second table engagement part defining a second range of table coupling positions, the second fastener configured to couple a second one of the leg sets to a second one of the table tops, wherein, when the extension table is in the second position, the table coupling positions of the second range are adjustable to enable movement between the second leg set and the second table top so as to reduce a force acting between the second table top and the at least one leaf.

17. The extension table of claim 16, wherein the first and second table tops are stationary when the extension table is in the second position, each of the first and second table engagement parts defining at least one slot configured to receive a coupler.

18. The extension table of claim 17, wherein: (a) the extension table extends along a longitudinal axis; and (b) when the extension table is in the second position, the first and second leg sets are configured to be adjustably positioned relative to each other along the longitudinal axis due to the first and second ranges of table coupling positions.

19. An extension table comprising:

a first leg set;

a second leg set;

a frame supported by the first and second leg sets;

first and second table tops supported by the frame, the first and second table tops configured to be slid back and forth relative to each other along an extension axis between: (a) a first stationary position in which the first and second table tops are pushed together when supported by the frame; and (b) a second stationary position in which the first and second table tops are fully pulled apart to define an opening when supported by the frame;

at least one leaf configured to be positioned in the opening and supported by the frame when the first and second table tops are in the second stationary position, wherein the first and second table tops and the at least one leaf are subject to forces due to expansion caused by a change in an environmental condition, the forces including: (a) a first force acting between the first table top and the at least one leaf; and (b) a second force acting between the second table top and the at least one leaf;

a first fastener comprising a first table mount, the first table mount defining variable securing points for a first coupler, the first fastener configured to mount the first leg set to the first table top, wherein, when the first and second table tops are in the second position, the variable securing points of the first table mount are adjustable to enable movement between the first leg set and the first table top along the extension axis so as to reduce the first force acting on the first table top; and a second fastener comprising a second table mount, the second table mount defining variable securing points for a second coupler, the second fastener configured to mount the second leg set to the second table top, wherein, when the first and second table tops are in the second position, the variable securing points of the second table mount are adjustable to enable movement between the second leg set and the second table top along the extension axis so as to reduce the second force acting on the second table top.

20. The extension table of claim 19, wherein: (a) the first and second table tops are stationary when in the second position, each of the first and second table mounts defining at least one opening configured to receive one of the couplers; and (b) when the first and second table tops are in the second position, the first and second leg sets are configured to be adjustably slid relative to each other along the extension axis due to the variable securing points of the first and second fasteners.

* * * * *